US011850532B2

(12) United States Patent
Simchoni

(10) Patent No.: US 11,850,532 B2
(45) Date of Patent: Dec. 26, 2023

(54) STACK AND NEST TOY

(71) Applicant: TOMY International, Inc., Oak Brook, IL (US)

(72) Inventor: Gal Simchoni, Mishmar Hashiva (IL)

(73) Assignee: TOMY International, Inc., Oak Brook, IL (US)

( * ) Notice: Subject to any disclaimer, the term of this patent is extended or adjusted under 35 U.S.C. 154(b) by 87 days.

(21) Appl. No.: 17/649,303

(22) Filed: Jan. 28, 2022

(65) Prior Publication Data

US 2023/0241525 A1 Aug. 3, 2023

(51) Int. Cl.
*A63H 33/04* (2006.01)
*A63H 33/06* (2006.01)

(52) U.S. Cl.
CPC ..... *A63H 33/067* (2013.01); *A63H 33/04* (2013.01)

(58) Field of Classification Search
CPC ..... A63H 33/00; A63H 33/04
See application file for complete search history.

(56) References Cited

U.S. PATENT DOCUMENTS 2,278,894 A * 4/1942 Nils ..... A63H 33/088 446/124
3,407,514 A * 10/1968 Christian ..... G09B 17/00 D19/64
4,699,601 A * 10/1987 Hershfeld ..... A63H 33/00 446/117
6,253,712 B1 * 7/2001 Johnson ..... F16L 11/18 285/261
8,834,225 B2 * 9/2014 Ferron ..... A63H 3/46 446/124
D728,695 S * 5/2015 Chase ..... A63H 33/088 D21/471
2003/0064656 A1 * 4/2003 Johnson ..... A45C 1/12 446/8

* cited by examiner

*Primary Examiner* — John A Ricci
(74) *Attorney, Agent, or Firm* — Husch Blackwell LLP

(57) ABSTRACT

A stack and nest toy is provided. The toy includes a plurality tube sections that each comprise a scaled variant of a matching shape such that a first of the plurality of tube sections is scaled to nest around a second of the plurality of tube sections. The second of the plurality of tube sections is scaled such that a respective outer surface of a bottom portion thereof is configured to interlock with a respective inner surface of a top portion of the first of the plurality of tube sections and, when the first of the plurality of tube sections is interlocked with the second one of the plurality of tube sections, an orientation of the first of the plurality of tube sections is rotationally different from an orientation of the second of the plurality of tube sections.

19 Claims, 6 Drawing Sheets

STACK AND NEST TOY

FIELD

The present invention generally relates to children's toys. More particularly, the present invention relates to a stack and nest toy.

BACKGROUND

Stack and nest toys are known in the art. However, such known stack and nest toys typically provide only a single type of tactile play experience for children. In particular, such known toys only provide children with a tactile play experience relating to the actual stacking and nesting of segments of the toy.

In view of the above, there is a continuing, ongoing need for an improved stack and nest toy that provides additional and unexpected tactile play experiences.

DETAILED DESCRIPTION

Figure 1:
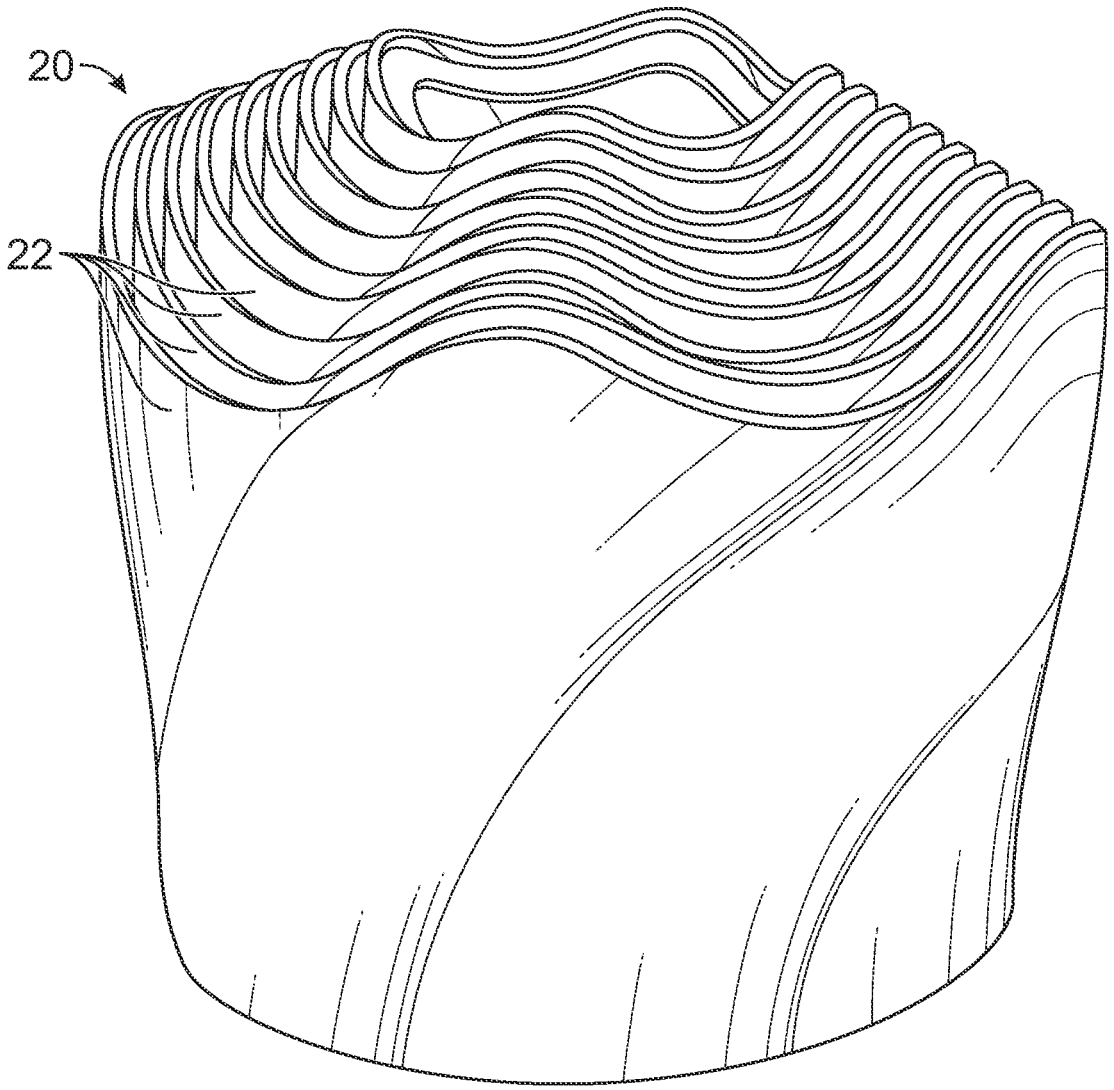
FIG. 1 is a perspective view of a toy in a nested configuration according to exemplary embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include a stack and nest toy 20 such as shown in FIG. 1. As seen in FIG. 1, the stack and nest toy 20 can include a plurality tube sections 22 that are configured such that larger ones of the plurality of tube sections 22 nest around smaller ones of the plurality of tube sections 22. For the purposes of explanation herein, "smaller ones of the plurality of tube sections 22" can mean a tube section 22 having a smaller width or general diameter at the widest point than another tube section's 22 widest point. In a preferred embodiment, each of the plurality of tube sections can have a different width or general diameter at the widest point. In particular, a first of the plurality of tube sections 22 can be configured to nest around a second of the plurality of tube sections 22. Furthermore, in some embodiments, the plurality of tube sections 22 can include a third of the plurality of tube sections 22 that either nests around the first of the plurality of tube sections 22 or nests within the second of the plurality of tube sections 22.

Figure 2:
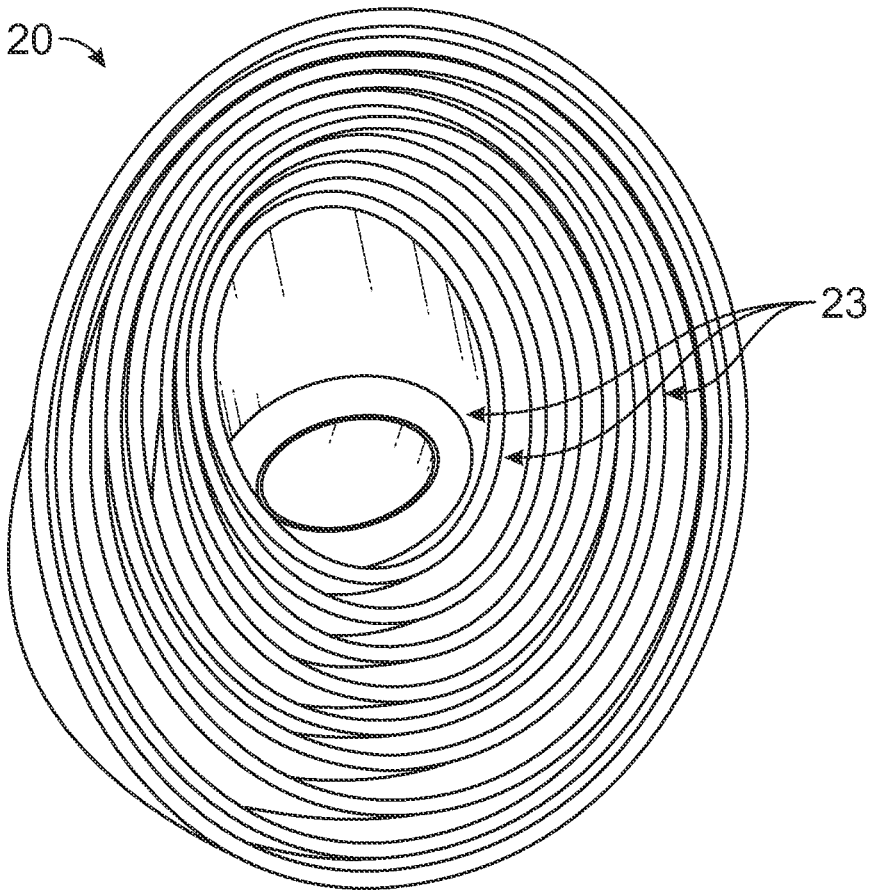
FIG. 2 is a bottom view of a toy in a nested configuration according to exemplary embodiments.
Figure 3:
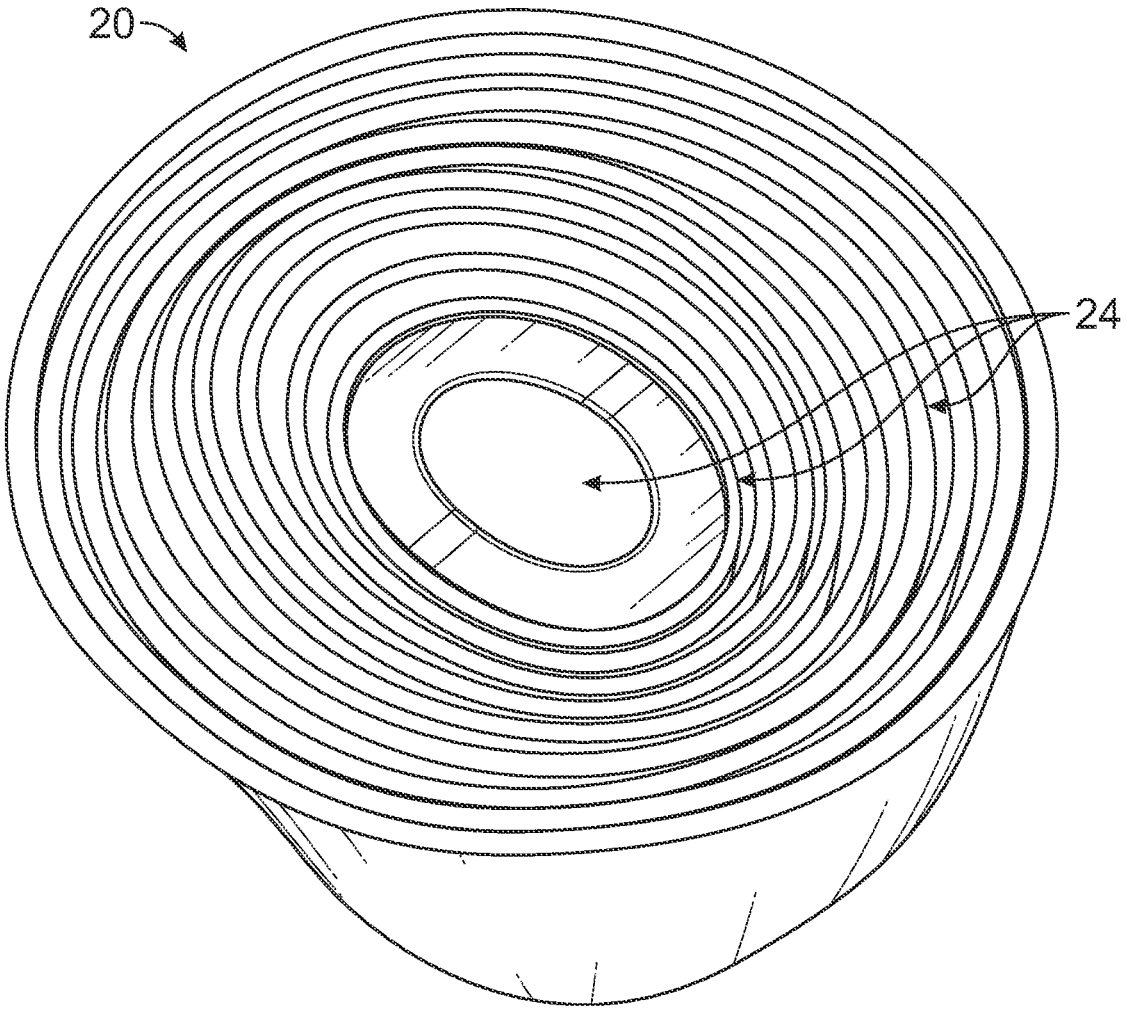
FIG. 3 is a top view of a toy in a nested configuration according to exemplary embodiments.
Figure 4:
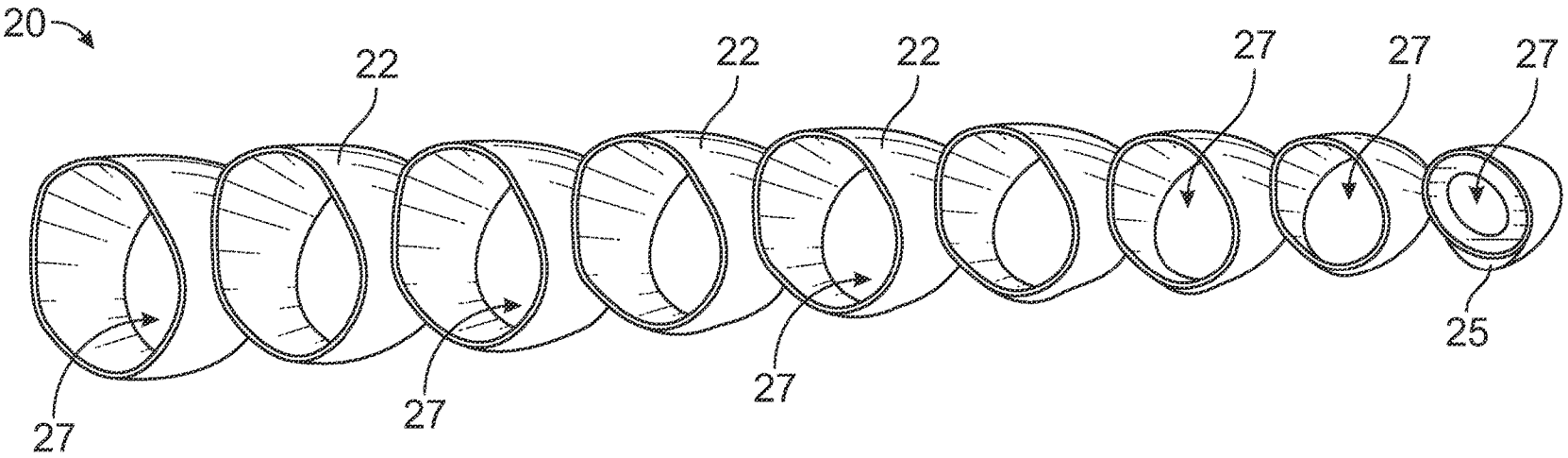
FIG. 4 is a top view of separated components of a toy according to exemplary embodiments.
Figure 5:
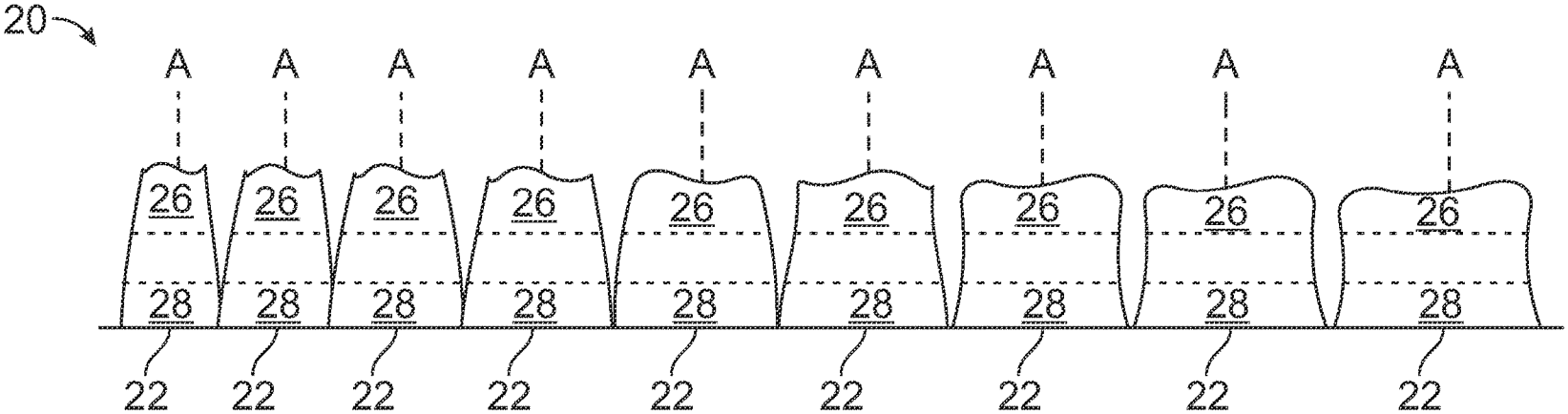
FIG. 5 is a front view of separated components of a toy according to exemplary embodiments.

In some embodiments, each of the plurality of tube sections 22 can comprise a scaled variant of a matching shape. As seen in FIG. 1, in some embodiments, the matching shape can include a truncated elliptic cone that is rotationally deformed. Furthermore, as seen in FIG. 2 and FIG. 3 each of the plurality of tube sections can include a first opening 23 and a second opening 24 that is smaller than the first opening 23. Further still, as seen in FIG. 4 and FIG. 5, in some embodiments, the matching shape which comprises each of the plurality of tube sections 22 can extend along a central axis A from the first opening 23 to the second opening 24, and a largest width dimension of the shape and a different smallest width dimension of the shape as measured perpendicular to the central axis A can both rotate about the central axis A and decrease in value as the shape progresses from the first opening 23 to the second opening 23 so as to form the rotationally deformed and truncated elliptic cone. Various other shapes are also contemplated as would be understood by those of ordinary skill in the art. As seen in FIGS. 2-4, in some embodiments, the first opening 23 and a second opening 24 can define an interior region 27.

As see in in FIG. 2 and FIG. 3, in some embodiments, smaller scaled ones of the plurality of tube sections 22 can be nested inside the interior region 27 of next largest ones of the plurality of tube sections 22. In some embodiments, the shape of the plurality of tube sections 22 can be such that the plurality of tube sections 22 only nest together when each of the plurality of tube sections 22 is arranged in single respective rotational position. In these embodiments, free rotation of the smaller scaled ones of the plurality of tube sections 22 can be limited by the position of the next largest ones of the plurality of tube sections 22 when each of the plurality of tube sections 22 are nested together. In some embodiments, the free rotation can be limited to less than plus or minus 90 degrees. Additionally or alternatively, in some embodiments, the free rotation can be limited to less than plus or minus 45 degrees.

FIG. 5 is a front view of the toy 20 showing each of the plurality of tube sections 22 unnested according to disclosed embodiments. As seen in FIG. 5, in some embodiments, the height of each of the plurality of tube sections 22 can increase from the largest to the smallest ones of the plurality of tube sections 22. For example, the second of the plurality of tube sections 22 can have a height that is greater than a height of the first of the plurality of tube sections 22. Furthermore, in some embodiments, each of the plurality of tube sections 22 can have a flat bottom and a wavey top where the maximum height varies around the top of each of the plurality of tube sections 22.

Figure 6:
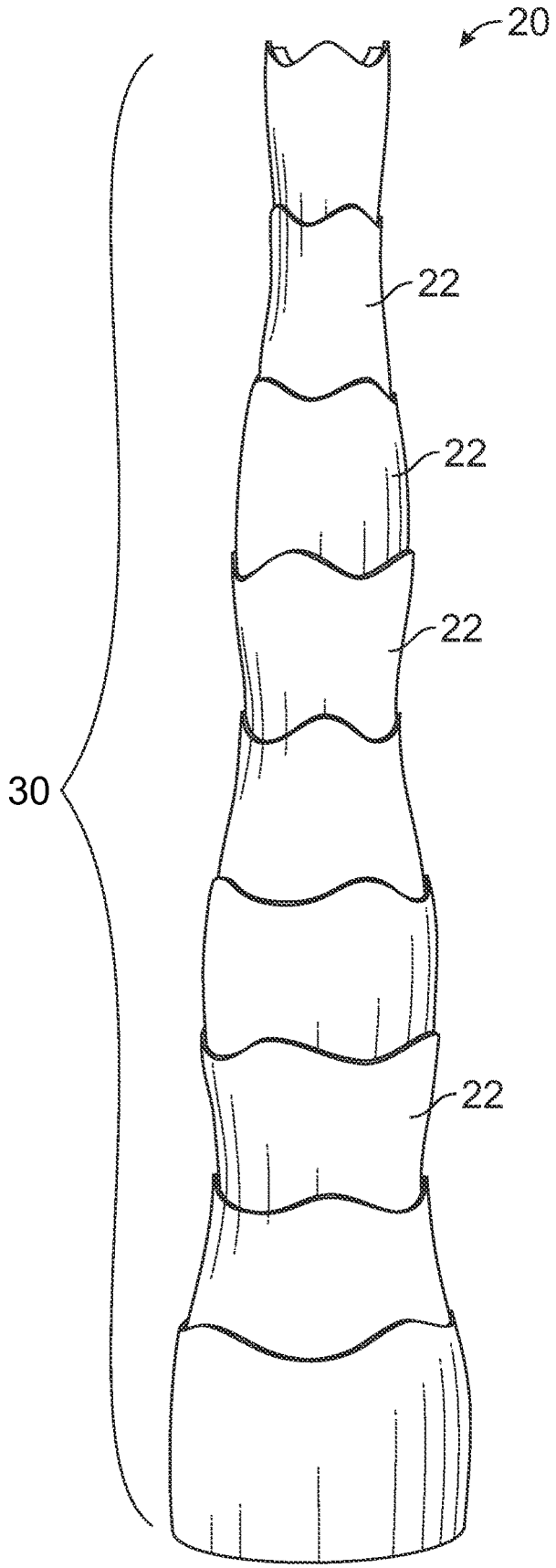
FIG. 6 is a front view of a toy in a tower configuration according to exemplary embodiments.

Furthermore, as seen in FIG. 5 each of the plurality of tube sections 22 can include a top portion 26 and a bottom portion 28. As seen in FIG. 6, in some embodiments, an outer surface of the bottom portion 28 of smaller ones of the plurality of tube sections 22 can be configured to interlock with an inner surface of the top portion 26 of next largest ones of the plurality of tube sections 22 to form a tower 30. In some embodiments, the plurality of tube sections 22 can interlock via friction. In some embodiments, the first opening 23 of the smaller ones of the plurality of tube sections 22 can be smaller than the first opening 23 of the next largest ones of the plurality of tube sections 22 but larger than the second opening 24 of the next largest ones of the plurality of tube sections 22 such that the smaller ones of the plurality of tube sections 22 cannot fully pass through the interior region 27 of the next largest ones of the plurality of tube sections 22.

In some embodiments, each of the plurality of tube sections 22 can be configured to interlock so as to form the tower 30 when a smallest one of the plurality of tube sections 22 is pulled through the interior region 27 of the next largest one of the plurality of tube sections 22 in which the smallest one of the plurality of tube sections 22 is nested. For example, the smallest of the plurality of tube sections 22 can be pulled through the interior region until the lower portion 28 thereof interlocks with the upper portion 26 of the next largest one thereof as described herein. From there, the same process can repeat for each of the plurality of tube sections 22 until all the corresponding upper portions 26 and lower portions 28 are interlocked and the tower 30 is formed. In embodiments where the plurality of tube sections 22 only nest together when each of the plurality of tube sections 22 is arranged in single respective rotational position, the corresponding upper portions 26 and lower portions 28 of each of the plurality of tube sections 22 can also only interlock together in another single rotational position. Furthermore, in these embodiments, pulling the smaller ones of the plurality of tube sections 22 through the next largest ones of the plurality of tube sections 22 can cause the smaller ones of the plurality of tube sections 22 to rotate until the smaller ones of the plurality of tube sections 22 reach the single respective rotational position where the smaller ones of the plurality of tube sections 22 interlock with the next largest ones of the plurality of tube sections 22.

As seen in FIG. 4, in some embodiments, the smallest one of the plurality of tube sections 22 can include a lip 25 configured to facilitate such an maneuver. In some embodiments, the lip 25 can be perpendicular to the central axis A and extend from the inner surface thereof into the interior region 27. In some embodiments the lip 25 can be located proximate to the second opening 24.

Figure 7:
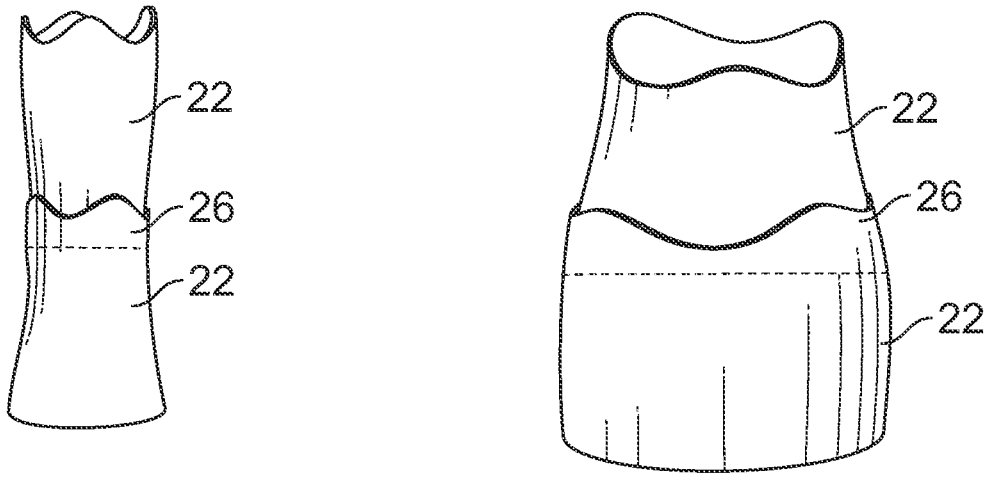
FIG. 7 is a front view of a toy in a tower configuration according to exemplary embodiments.
Figure 8:
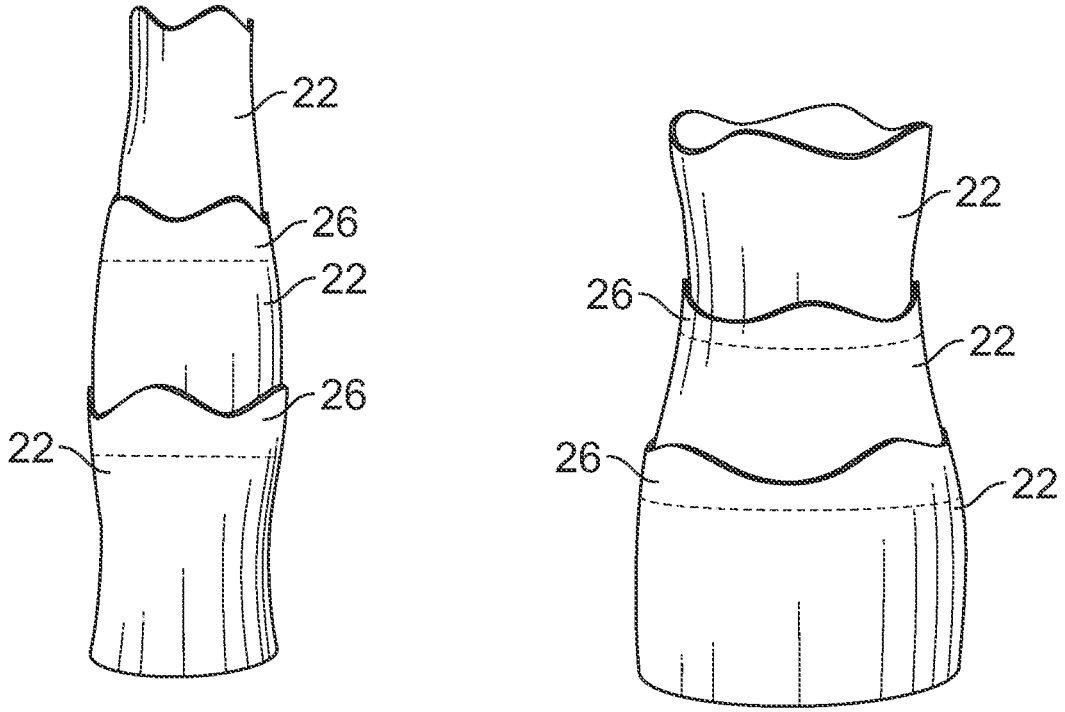
FIG. 8 is a front view of a toy in a tower configuration according to exemplary embodiments.

In some embodiments, the tower 30 can be broken down into smaller sections comprising 2 or more of the plurality of tube sections 22 as seen in FIG. 7 and FIG. 8. For example, in embodiments where the tower 30 comprises the first and second of the plurality of tube sections 22, the second of the plurality of tube sections 22 can be scaled such that outer surface of the bottom portion 28 thereof is configured to interlock with the inner surface of the top portion 26 of the first of the plurality of tube sections 22. Furthermore, in embodiments where the tower 30 comprises the first, second, and third of the plurality of tube sections 22 and the third of the plurality of tube sections 22 is scaled to nest within the second of the plurality of tube sections 22, the third of the plurality of tube sections 22 can be scaled such that the outer surface of the bottom portion 28 thereof is configured to interlock with the inner surface of the top portion 26 of the second of the plurality of tube sections 22. Additionally or alternatively, in embodiments where the tower 30 comprises the first, second, and third of the plurality of tube sections 22 and where the third of the plurality of tube sections 22 is scaled to nest around the first of the plurality of tube sections 22, the first of the plurality of tube sections 22 can be scaled such that the outer surface of the bottom portion 28 thereof is configured to interlock with the inner surface of the top portion 26 of the third of the plurality of tube sections 22.

As seen in FIGS. 6-8, in some embodiments, when each of the plurality of tube sections 22 are interlocked together to form the tower 30, a respective orientation of each of the plurality of tube sections 22 is rotationally different from the respective orientation of one or more other ones of the plurality of tube sections 22. For example, in embodiments where the tower 30 comprises the first and second of the plurality of tube sections 22, an orientation of the first of the plurality of tube sections 22 is rotationally different from an orientation of the second of the plurality of tube sections 22. Furthermore, in embodiments where the tower 30 comprises the first, second, and third of the plurality of tube sections 22 and the third of the plurality of tube sections 22 is scaled to nest within the second of the plurality of tube sections 22, the orientation of the first of the plurality of tube sections 22 is rotationally different from the orientation of the second of the plurality of tube sections 22 and an orientation of the third of the plurality of tube sections 22. Additionally or alternatively, in embodiments where the tower 30 comprises the first, second, and third of the plurality of tube sections 22 and where the third of the plurality of tube sections 22 is scaled to nest around the first of the plurality of tube sections 22, the orientation of the first of the plurality of tube sections 22 is rotationally different from the orientation of the second of the plurality of tube sections 22 and the orientation of the third of the plurality of tube sections 22.

In some embodiments, the differing rotational orientation of the plurality of tube sections 22 can produce an overall geometry for the tower 30 that is similar to the matching shape of each of the plurality of tube sections 22 such as the rotationally deformed and truncated elliptic cone or other shape. For example, in some embodiments, a largest width dimension and a different smallest width dimension of the tower as measured perpendicular to the central axis A can both rotate about the central axis A and decrease in value as the tower progresses from bottom to top. However, in some embodiments, because the tower 30 is formed from the discrete plurality of tube sections 22, the tower 30 can include a discontinuous lip where smaller ones of the plurality of tube sections 22 are interlocked with the next largest ones of the plurality of tube sections 22.

Embodiments described herein can also be directed to a method for forming the tower 30. Such a method can include stacking the plurality of tube sections 22 into a concentric arrangement such as shown in FIGS. 1-3 such that the smaller ones of the plurality of tube sections 22 are nested inside of the larger ones of the plurality of tube sections 22. Next the method can include pulling one of the plurality of tube sections 22 out from the concentric arrangement to form the tower 30. For example, in some embodiments, the smallest of the plurality of tube sections 22 can be pulled on to form the tower 30. However, in embodiments where the concentric arrangement is positioned as shown in FIG. 2 with the first opening 23 of each of the plurality of tube sections 22 on top, the largest one of the plurality of tube sections 22 can be pulled out to form the tower 30.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A toy comprising:

a first tube section that extends along a first axis between a first opening and a second opening, wherein the first opening is larger than the second opening, and a largest width dimension and a different smallest width dimension of the first tube section, as measured perpendicular to the first axis, rotate about the first axis and decrease in value as the first tube section progresses from the first opening to the second opening; and a second tube section configured to nest within the first tube section, wherein the second tube section extends along a second axis between a third opening and a fourth opening, wherein the third opening is larger than the fourth opening, and a largest width dimension and a different smallest width dimension of the second tube section, as measured perpendicular to the second axis, rotate about the second axis and decrease in value as the second tube section progresses from the third opening to the fourth opening, wherein the third opening is smaller than the first opening and larger than the second opening such that the second tube section is configured to nest within the first tube section.

2. The toy of claim 1, wherein a respective outer surface of a bottom portion of the second tube section is configured to interlock with a respective inner surface of a top portion of the first tube section when the second tube section is pulled and rotated through a first interior region defined by the first opening and the second opening, wherein a respective shape of the first tube section and the second tube section is configured such that the respective outer surface of the bottom portion of the second tube section and the respective inner surface of the top portion of the first tube section interlock when the first tube section and the second tube section are positioned in a respective single rotational position.

3. The toy of claim 1 wherein a respective outer surface of a bottom portion of the second tube section is configured to interlock with a respective inner surface of a top portion of the first tube section when the second tube section is pulled through a first interior region defined by the first opening and the second opening, and wherein the second tube section includes a lip perpendicular to the second axis and extending from an inner surface of the second tube section into a second interior region defined by the third opening and the fourth opening, wherein the lip is located proximate to the fourth opening.

4. The toy of claim 1 wherein a respective outer surface of a bottom portion of the second tube section is configured to interlock with a respective inner surface of a top portion of the first tube section when the second tube section is pulled through a first interior region defined by the first opening and the second opening, and wherein the respective outer surface of the bottom portion of the second tube section is configured to interlock via friction with the respective inner surface of the top portion of the first tube section.

5. The toy of claim 1 further comprising:

a third tube section configured to nest within the second tube section, wherein the third tube section extends along a third axis between a fifth opening and a sixth opening, wherein the fifth opening is larger than the sixth opening, and a largest width dimension and a different smallest width dimension of the third tube section, as measured perpendicular to the third axis, rotate about the third axis and decrease in value as the third tube section progresses from the fifth opening to the sixth opening.

6. The toy of claim 1 wherein the second tube section has a height that is greater than a height of the first tube section.

7. The toy of claim 1 wherein the second tube section comprises a shape that is a smaller scaled variant of a shape that comprises the first tube section, and wherein a respective top of the first and second tube sections is wavy, and a respective bottom of the first and second tube sections is flat.

8. A toy comprising:

a plurality tube sections that each comprise a scaled variant of a matching shape such that a first of the plurality of tube sections is scaled to nest around a second of the plurality of tube sections when each of the plurality of tube sections is arranged in a first single respective rotational position, wherein the second of the plurality of tube sections is scaled such that a respective outer surface of a bottom portion thereof is configured to interlock with a respective inner surface of a top portion of the first of the plurality of tube sections when the second of the plurality of tube sections is arranged in a second single rotational position, and wherein when the first of the plurality of tube sections is interlocked with the second one of the plurality of tube sections, an orientation of the first of the plurality of tube sections is rotationally different from an orientation of the second of the plurality of tube sections.

9. The toy of claim 8 wherein the shape which comprises each of the plurality of tube sections extends along a central axis from a first opening to a second opening, wherein the first opening is larger than the second opening, and a largest width dimension and a different smallest width dimension of the shape, as measured perpendicular to the central axis, rotate about the first axis and decrease in value as the shape progresses from the first opening to the second opening.

10. The toy of claim 9 wherein a second of the plurality of tube sections includes a lip perpendicular to the central axis and extending from an inner surface thereof into an interior region defined by the first opening and the second opening, wherein the lip is located proximate to the second opening.

11. The toy of claim 8 wherein a third of the plurality of tube sections is scaled to nest within the second of the plurality of tube sections, wherein the third of the plurality of tube sections is scaled such that a respective outer surface of a bottom portion thereof is configured to interlock with a respective inner surface of a top portion of the second of the plurality of tube sections when the third of the plurality of tube sections is arranged in a third single rotational position, and wherein when the third of the plurality of tube sections is interlocked with the second of the plurality of tube sections and the second of the plurality of tube sections is interlocked with the first of the plurality of tube sections, the orientation of the first of the plurality of tube sections is rotationally different from the orientation of the second of the plurality of tube sections and an orientation of the third of the plurality of tube sections.

12. The toy of claim 8 wherein a third of the plurality of tube sections is scaled to nest around the first of the plurality of tube sections, wherein the first of the plurality of tube sections is scaled such that a respective outer surface of a bottom portion thereof is configured to interlock with a respective inner surface of a top portion of the third of the plurality of tube sections when the third of the plurality of tube sections is arranged in a third single rotational position, and wherein when the third of the plurality of tube sections is interlocked with the first of the plurality of tube sections and the second of the plurality of tube sections is interlocked with the first of the plurality of tube sections, the orientation of the first of the plurality of tube sections is rotationally different from the orientation of the second of the plurality of tube sections and an orientation of the third of the plurality of tube sections.

13. The toy of claim 8 wherein the second of the plurality of tube sections has a height that is greater than a height of the first of the plurality of tube sections and wherein a respective top of each of the plurality of tube sections is wavey and a respective bottom of each of the plurality of tube sections is flat.

14. The toy of claim 8 wherein the first of the plurality of tube sections interlocks with the second of the plurality of tube sections when the second of the plurality of tube sections is pulled and rotated through a first interior region of the first of the plurality of tube sections until the second of the plurality of tube sections is positioned in the second single rotational position.

15. The toy of claim 8 wherein the respective outer surface of the bottom portion of the second of the plurality of tube sections is configured to interlock via friction with the respective inner surface of the top portion of the first of the plurality of tube sections.

16. A method comprising:

stacking a plurality of tube sections into a concentric arrangement such that smaller ones of the plurality of tube sections are nested inside of larger ones of the plurality of tube sections and are arranged in a first single respective rotational position, wherein each of the plurality tube sections that comprise a scaled variant of a matching shape; and pulling one of the plurality of tube sections out from the concentric arrangement to form a tower that includes each of the plurality of tube sections interlocked together and arranged in a second single respective rotational position, wherein, when each of the plurality of tube sections are interlocked together to form the tower, a respective orientation of each of the plurality of tube sections is rotationally different from the respective orientation of one or more other ones of the plurality of tube sections.

17. The method of claim 16 wherein, when each of the plurality of tube sections are interlocked together to form the tower, a respective outer surface of a bottom portion of smaller ones of the plurality of tube sections interlock with a respective inner surface of a top portion of next largest ones of the plurality of tube sections.

18. The method of claim 16 wherein a smallest of the plurality of tube sections includes a lip perpendicular to a central axis thereof and extending from an inner surface thereof into an interior region of the smallest of the plurality of tube sections.

19. The method of claim 16 wherein each of the plurality of tube sections are interlocked together via friction to form the tower.

* * * * *